US007056463B2

(12) United States Patent
Ohta

(10) Patent No.: US 7,056,463 B2
(45) Date of Patent: Jun. 6, 2006

(54) METHOD OF MANUFACTURING PRESTRESSED CONCRETE

(75) Inventor: Toshiaki Ohta, Fukuoka (JP)

(73) Assignee: Japan Science and Technology Agency, Saitama (JP)

( * ) Notice: Subject to any disclaimer, the term of this patent is extended or adjusted under 35 U.S.C. 154(b) by 144 days.

(21) Appl. No.: 10/478,362

(22) PCT Filed: May 17, 2002

(86) PCT No.: PCT/JP02/04777

§ 371 (c)(1),
(2), (4) Date: Nov. 21, 2003

(87) PCT Pub. No.: WO02/094525

PCT Pub. Date: Nov. 28, 2002

(65) Prior Publication Data

US 2004/0130063 A1 Jul. 8, 2004

(30) Foreign Application Priority Data

May 24, 2001 (JP) ..... 2001-155673

(51) Int. Cl.
*B28B 5/00* (2006.01)

(52) U.S. Cl. ..... 264/228; 264/229; 264/249; 264/274; 264/279; 264/279.1; 156/162; 156/169; 156/172; 52/223.13; 52/223.14

(58) Field of Classification Search ..... 264/228, 264/229, 249, 274, 279, 279.1; 156/161, 156/162, 169, 171, 172, 180; 52/223.13, 52/223.14

See application file for complete search history.

(56) References Cited

U.S. PATENT DOCUMENTS

| | | | | | |
|---|---|---|---|---|---|
| 2,406,270 | A | * | 8/1946 | Torell et al. | 57/202 |
| 3,086,273 | A | * | 4/1963 | Welborn | 264/228 |
| 3,111,569 | A | * | 11/1963 | Rubenstein | 52/223.14 |
| 3,115,727 | A | * | 12/1963 | Middendorf | 52/223.13 |
| 3,190,065 | A | * | 6/1965 | Little | 57/212 |
| 3,290,840 | A | * | 12/1966 | Middendorf | 52/223.13 |
| 3,347,005 | A | * | 10/1967 | Preston, Jr. | 52/223.14 |
| 3,399,437 | A | * | 9/1968 | Kelly | 425/111 |
| 3,422,586 | A | * | 1/1969 | Parma | 52/223.14 |
| 3,513,609 | A | * | 5/1970 | Lang | 52/223.6 |
| 3,837,372 | A | * | 9/1974 | Bernot | 140/92.2 |
| 3,858,991 | A | * | 1/1975 | Burtelson | 403/194 |

(Continued)

FOREIGN PATENT DOCUMENTS

JP 04-312659 A * 11/1992

(Continued)

OTHER PUBLICATIONS

English Translation of JP 04-312659 A, Dec. 2004, FLS, Inc.*

(Continued)

*Primary Examiner*—Michael P. Colaianni
*Assistant Examiner*—Patrick Butler
(74) *Attorney, Agent, or Firm*—The Webb Law Firm

(57) ABSTRACT

Pre-tension and post-tension processes for the manufacture of pre-stressed structures in which bonded carbon fiber cables are provided with burial anchors and temporary anchors outward of the burial anchors. The burial anchors are embedded in the structure. The temporary anchors enable stressing of the carbon fiber cables.

8 Claims, 4 Drawing Sheets

U.S. PATENT DOCUMENTS

| | | | | | |
|---|---|---|---|---|---|
| 4,121,325 | A | * | 10/1978 | Bruinette et al. | 24/122.6 |
| 4,350,549 | A | * | 9/1982 | Frehner | 156/161 |
| 4,469,756 | A | * | 9/1984 | Jungwirth et al. | 428/592 |
| 4,574,545 | A | * | 3/1986 | Reigstad et al. | 52/223.6 |
| 4,726,163 | A | * | 2/1988 | Jacobs | 52/223.6 |
| 4,849,282 | A | * | 7/1989 | Watanabe et al. | 428/321.5 |
| 4,866,903 | A | * | 9/1989 | Ferstay | 52/677 |
| 5,308,696 | A | * | 5/1994 | Hanashita et al. | 428/357 |
| 5,423,362 | A | * | 6/1995 | Knight | 249/91 |
| 5,540,030 | A | * | 7/1996 | Morrow | 52/742.13 |
| 5,580,642 | A | * | 12/1996 | Okamoto et al. | 428/212 |
| 5,939,003 | A | * | 8/1999 | Crigler et al. | 264/228 |
| 6,082,063 | A | * | 7/2000 | Shrive et al. | 52/223.13 |
| 6,209,279 | B1 | * | 4/2001 | Meier et al. | 52/649.1 |

FOREIGN PATENT DOCUMENTS

| | | | |
|---|---|---|---|
| JP | 04-366258 | A | 12/1992 |
| JP | 09-177246 | A | 7/1997 |
| JP | 11-124957 | A | 5/1999 |
| JP | 11-350736 | A | 12/1999 |
| JP | 2000-220254 | A | 8/2000 |
| JP | 2001-311259 | A | 11/2001 |

OTHER PUBLICATIONS

English Machine Translation of JP 09-177246 A, Jun. 2005, Japanese Patent Office website.*

English Machine Translation of JP 11-124957 A, Jun. 2005, Japanese Patent Office website.*

English Machine Translation of JP 11-350736 A, Jun. 2005, Japanese Patent Office website.*

English Machine Translation of JP 2000-220254 A, Jun. 2005, Japanese Patent Office website.*

English Machine Translation of JP 2001-311259 A, Jun. 2005, Japanese Patent Office website.*

* cited by examiner

METHOD OF MANUFACTURING PRESTRESSED CONCRETE

BACKGROUND OF THE INVENTION

1. Field of the Invention

The present invention relates to a method of manufacturing pre-stressed concrete members, which are reinforced with carbon fiber, useful as pillars, columns, spars, beams or the like of building, civil engineering or offshore structures and so on.

2. Description of the Related Art

Pillar, columns, spars, beams or the like in a building, constructing or engineering field are fabricated from concrete members reinforced with steel rods or fiber-reinforced plastics (FRP). Although the steel rod is a representative reinforcing member, it is heavy and requires a broad workspace for processing and handling the reinforced concrete member. The steel rod shall be stored in a properly controlled atmosphere due to its poor corrosion-resistance. Especially, a post-tension concrete member, which has the structure that steel anchors are embedded in a concrete body at both ends, is significantly damaged in a corrosive atmosphere near a seaside.

Application of thermosetting carbon fibers or fiber cables to pre-stressed concrete members has been researched and developed, aiming at lightening and improved corrosion-resistance of the concrete members. In fact, prepregs, which are prepared by bundling many carbon filaments of 10 μm or less in diameter and impregnating the fiber bundle with a thermosetting primer, are sometimes used as carbon fiber cables. Composite members, which are prepared by forming and curing a woven fiber bundle, are also used for reinforcement of concrete members.

Thermosetting carbon fibers and carbon fiber cables are very expensive due to complicated manufacturing process, so that concrete members reinforced with such fibers or cables can not be used to various fields in point of economical view. Carbon fiber cables are often embedded in a loosed state, resulting in poor fatigue strength of the concrete members. Moreover, steel anchors, which are likely to be damaged in a corrosive atmosphere, are still used for prestressed concrete members reinforced with carbon fiber cables. In short, corrosion of the concrete members in a salty atmosphere is not fundamentally dissolved only by use of thermosetting carbon fibers or carbon fiber cables for reinforcement.

SUMMARY OF THE INVENTION

The present invention aims at provision of concrete members, which are reinforced with stretched straight carbon fiber cables, excellent in fatigue strength, corrosion-resistance and mechanical properties. An object of the present invention: is to offer concrete members, which can be installed without steel anchors.

The inventive concrete member is manufactured by either of post-tension and pre-tension processes.

According to a post-tension process, continuous carbon filaments are held parallel to each other and bonded together at proper parts with an adhesive to prepare a straight carbon fiber cable. After burial anchors are attached to both ends of the carbon fiber cable, the carbon fiber cable is inserted in a sheath and set in a molding box. Green concrete is poured in the molding box and steam-aged to a predetermined profile. The sheath is filled with grout under the condition that the carbon fiber cable is stretched by pulling tentative anchors. After the grout is hardened, the carbon fiber cable is released from tension.

According to a pre-tension process, continuous carbon filaments are held parallel to each other and bonded together at proper positions with an adhesive to prepare a straight carbon fiber cable. The carbon fiber cable is processed to a main reinforcing member by attaching burial anchors. Tentative anchors are attached to both ends of the main reinforcing member. The tentative anchors are clamped to an anchor-fixing discs. At least a carbon fiber hoop is wound around a plurality of the straight carbon fiber cables and bonded thereto with an adhesive. The main reinforcing member, which has the carbon fiber hoops fixed to the carbon fiber cables, is set in a molding box. Green concrete is poured in the molding box under the condition that the main reinforcing member is stretched by pulling the tentative anchors. The green concrete is steam-aged to a predetermined profile in the molding box. Thereafter, the main reinforcing member is released from tension.

In any of the post-tension and pre-tension processes, burial anchors are bonded to the carbon fiber cable at its both ends or parts near the ends. The burial anchor is prepared by forming a carbon fiber bundle to a U-shaped profile. The burial anchor may be a part of the carbon fiber cable shaped to a predetermined profile. The U-shaped anchor preferably has a flat bottom perpendicular to a longitudinal direction of the concrete member. The burial anchor is completely buried in a concrete body without such projection as noted in a conventional steel anchor.

A burial anchor, which is bonded to a carbon fiber cable, is a U-shaped carbon fiber cable. It is bonded to a folded end of a carbon fiber bundle extending from an end of the straight carbon fiber cable.

A burial anchor, which is a part of a straight carbon fiber cable, is prepared as follows: A plurality of straight carbon fiber bundles are arranged in a toroidal state each parallel to the other. A banding carbon fiber bundle is wound onto straight parts of the carbon fiber bundles. A cold-setting low-viscosity resin bond is infiltrated to the banded parts and cured, so as to form the burial anchor at both ends of the carbon fiber cable.

A main reinforcing member is formed to a proper length with ease by bonding two or more straight carbon fiber cables. In this case, carbon filaments of each carbon fiber cable are overlaid on and bonded to carbon filaments of the other carbon fiber cable. After each carbon fiber bundle is untied, its filaments are intertwined with filaments of the other carbon fiber bundle and the carbon fiber bundles are firmly bonded together.

DETAILED DESCRIPTION OF THE INVENTION

A composite member, which is prepared by impregnating a carbon fiber bundle with a thermosetting primer, forming the prepreg to a predetermined profile and then curing the thermosetting primer, has been used as a carbon fiber cable for a pre-stressed concrete member. The inventive carbon fiber cable is different from the conventional composite member, since it is fabricated without steps of pre-impregnation and thermosetting. Due to omission of pre-impregnating and thermosetting steps, the carbon fiber cable is offered at a low cost.

According to the present invention, carbon filaments are bundled in a state each parallel to the other, and the carbon fiber bundle is formed to a straight carbon fiber cable by application of a certain tension. A cold-setting low-viscosity resin bond is infiltrated into the straight carbon fiber cable and then cured at a temperature of 60° C. or lower during steam-aging concrete. The cold-setting low-viscosity resin bond preferably has a cure temperature of 20±10° C. and viscosity of 700–1000 mPa·sec.

A burial anchor is also prepared from the same straight carbon fiber cable, as follows: The straight carbon fiber cable is bent to a U-shape, and upper parts of the U-shaped carbon fiber cable are coupled with a tendon. A middle part between the coupled parts is straightened, while a bottom of the U-shaped carbon fiber cable is reformed to a flatter and wider profile than the other part. A resin bond is infiltrated into the carbon fiber cable and cured therein. The U-shaped carbon exhibits an elevated anchoring effect due to the flattened bottom, when the anchor is buried in grout hardened in a sheath or a concrete body. The anchor made of the straight carbon fiber cable is also excellent in corrosion-resistance and handled with ease.

A hoop, which is used in a pre-tension process, is also prepared from a straight carbon fiber cable. Two or more straight carbon fiber cables as a main reinforcing member are arranged parallel to each other. A carbon fiber hoop is wound around the straight carbon fiber cables. A cold-setting low-viscosity resin bond is infiltrated into the main reinforcing member and the hoop at the crossing points. The hoop is formed at a part of the main reinforcing member by curing the resin bond.

Since straight carbon fiber cables are used as main reinforcing member, burial anchors and hoops, pre-stressed concrete members, which are lightened (e.g. a fourth of a conventional concrete member reinforced with a steel rod by specific gravity) and well resistant to corrosion in a salty atmosphere, are manufactured. Due to excellent corrosion-resistance, the concrete members are easily handled or stored and also installed with good durability.

The other features of the present invention will be clearly understood from the following explanation consulting with drawings attached herewith.

[Preparation of a Straight Carbon Fiber Cable]

Figure 1A:
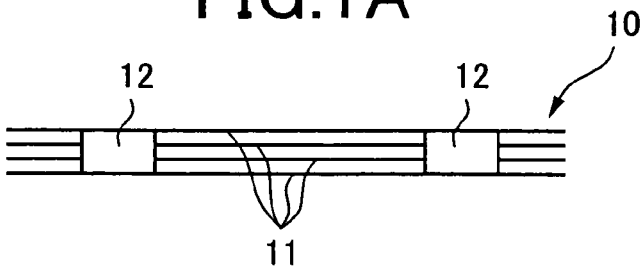
FIG. 1A is a schematic view illustrating a straight carbon fiber cable, in which carbon fiber bundles are bonded together at predetermined positions along a longitudinal direction.
Figure 1B:
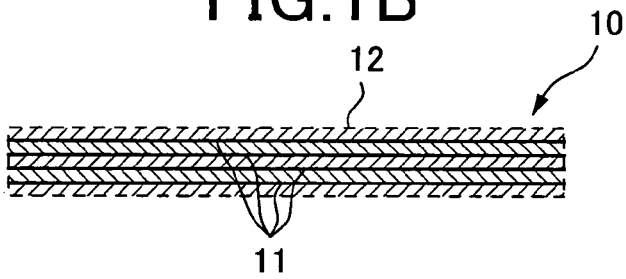
FIG. 1B is a sectional view illustrating a straight carbon fiber cable impregnated with a cold-setting low-viscosity resin bond.

Continuous carbon filaments 11 are arranged and stretched in a state parallel to each other, so as to form a straight carbon fiber cable 10. The carbon filaments 11 are fixed together by a cold-setting resin bond 12 at proper positions along a longitudinal direction, as shown in FIG. 1A. In the case where the carbon fiber cable 10 is used for reinforcement of a pre-stressed concrete member, it is reformed to a tight state and impregnated with a cold-setting low-viscosity resin bond. Each carbon filament 11 is firmly bonded with the other by curing the resin bond, as shown in FIG. 1B. Since the straight carbon fiber cable 10 is prepared by stretching continuous carbon filaments 11 and bonding the filaments 11 together, it is not loosened but improved in fatigue strength as compared with a conventional stranded cable.

Infiltration and curing of the cold-setting resin bond in the straight carbon fiber cable 10 may be performed in a cable-fabricating yard or a pre-stressed concrete member-manufacturing yard. In any case, use of the straight carbon fiber cable 10 remarkably eliminates difficulty on production and handling of a reinforced concrete member, and saves a working space necessary for fabrication and preparation of reinforcing members. Consequently, pre-stressed concrete members are manufactured and installed at a low cost. Moreover, it is possible to automatically on-line control arrangement of reinforcing members and production of pre-stressed concrete members.

Figure 2:
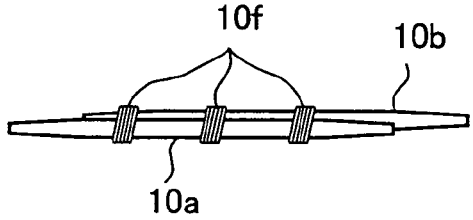
FIG. 2 is a side view illustrating a bonded joint between two straight carbon fiber cables.

Two or more straight carbon fiber cables 10 may be tied each other to a predetermined length suitable for a purpose, as shown in FIG. 2. When the straight carbon fiber cables 10*a*, 10*b* are tied together, carbon fibers 10*f* are preferably wound onto the tied joint for reinforcement.

In the case where two or more straight carbon fiber cables 10*a*, 10*b* are tied together to, a predetermined length necessary for a practical use, one straight carbon fiber cable 10*a* is overlaid on the other straight carbon fiber cable 10*b*, a cold-setting resin bond 12 is infiltrated into the overlaid part of the straight carbon fiber cables 10*a*, 10*b*, and the straight carbon fiber cables 10*a*, 10*b* are banded together with carbon fibers 10*f*. Thereafter, the cold-setting resin bond 12 is cured so as to bond the carbon fibers 10*f* to the carbon fiber cables 10*a*, 10*b*. A fiber bundle of each carbon fiber cables 10*a*, 10*b* may be untied and intertwined at the joint before infiltration of the cold-setting resin bond 12, in order to strengthen the tied joint.

[Fixation of a Burial Anchor]

Figure 3:
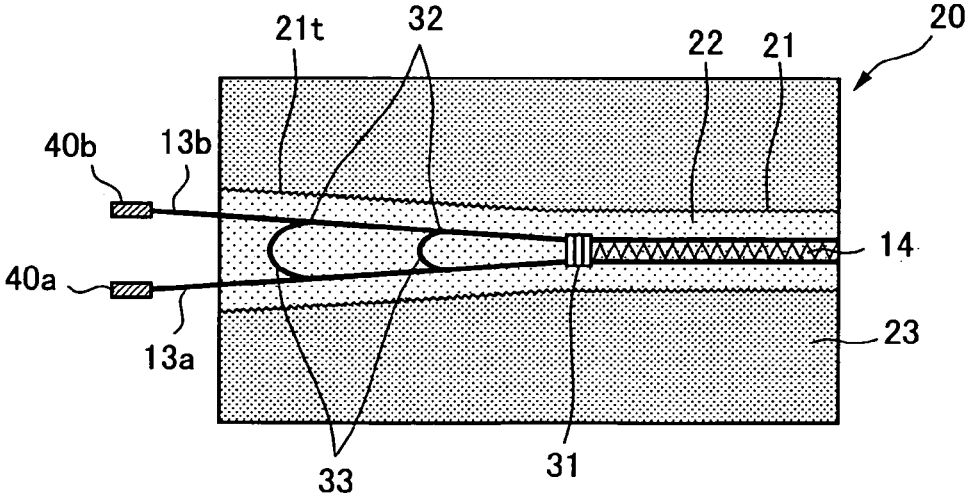
FIG. 3 is a sectional view illustrating a post-tension process, whereby an anchor is bonded to an end of a straight carbon fiber cable.
Figure 4A:
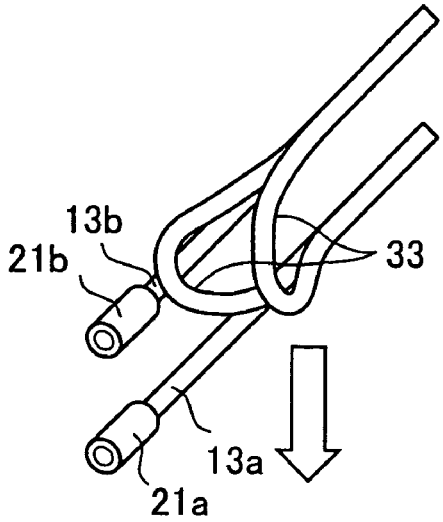
FIG. 4A is a perspective view illustrating a part of a straight carbon fiber cable, to which a U-shaped carbon fiber anchor is bonded.
Figure 4B:
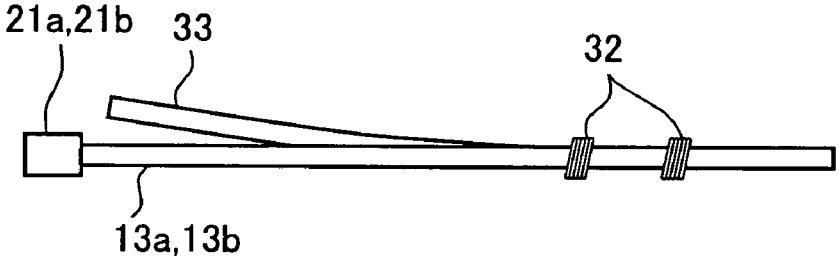
FIG. 4B is a side view illustrating the same part of the straight carbon fiber cable.

After a straight carbon fiber cable 10 is banded with a ring 31 at its end, carbon fiber bundles 13*a*, 13*b* are pulled out beyond the ring 31. Reinforcing members 32 are bonded to the carbon fiber bundles 13*a*, 13*b* with a resin bond, and one or more U-shaped carbon fiber anchors 33, 33 are inserted as burial anchors between the carbon fiber bundles 13*a*, 13*b*. (FIGS. 3, 4A and 4B)

Figure 5:
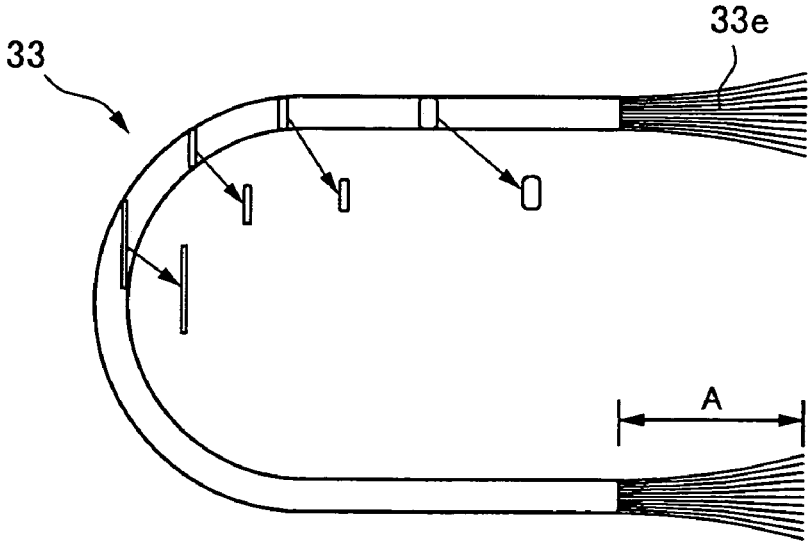
FIG. 5 is a plan view illustrating a U-shaped carbon fiber anchor, which will be bonded to an end of a straight carbon fiber cable.

The U-shaped carbon fiber anchor 33 may be untied to separate filaments at jointing ends 33*e* in a predetermined length A, as shown in FIG. 5. The separate filaments are intertwined with filaments of the straight carbon fiber bundles 13*a*, 13*b*, and a resin; bond is infiltrated into the intertwined part, whereby the U-shaped carbon fiber anchors 33 are firmly bonded to the straight carbon fiber bundles 13*a*, 13*b* by curing the infiltrated resin bond.

The U-shaped carbon fiber anchor 33 preferably has a flattened bottom in order to enlarge its bearing area with respect to grout 22. The U-shaped carbon fiber anchor 33, which is preformed to a certain profile by infiltrating a thermosetting resin bond to a part except the jointing ends 33*e* and curing the infiltrated resin bond therein, is bonded to a straight carbon fiber cable 10 in a cable-fabricating yard or a pre-stressed concrete-manufacturing yard.

Figure 6A:
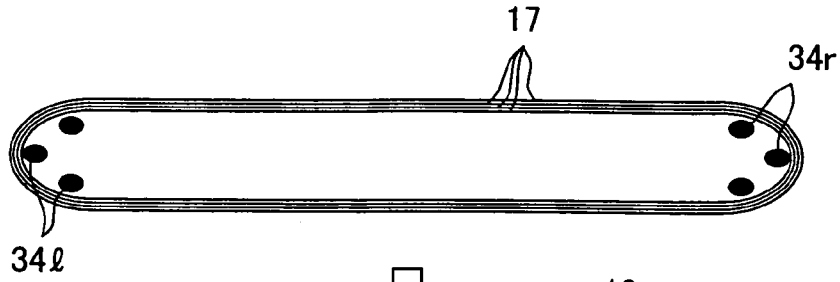
FIGS. 6A, 6B, and 6C together comprise a flow chart illustrating formation of a burial anchor at an end of a straight carbon fiber cable.
Figure 6B:
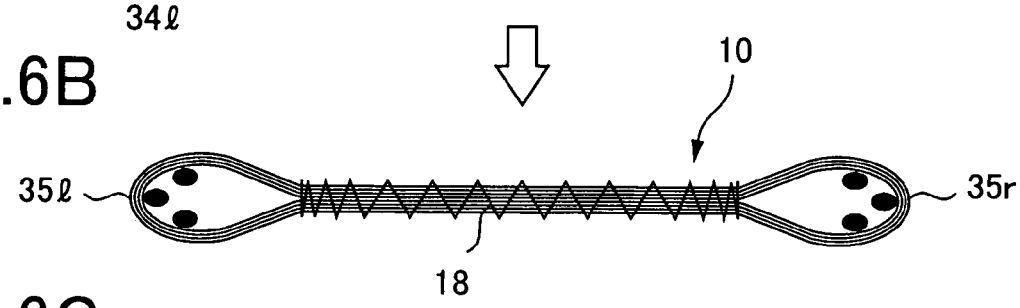
Figure 6C:
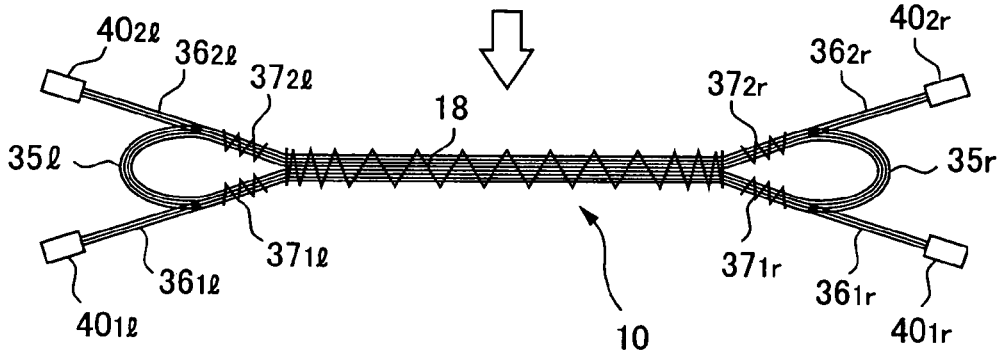

A U-shaped carbon fiber anchor 35, which is formed from an end part of a straight carbon fiber cable 10, may be used instead of the separate U-shaped carbon fiber anchor 33. The integrated U-shaped carbon fiber anchor is fabricated as follows:

Carbon fiber bundles 17 are arranged in a toroidal state each parallel to the other, and expanded at both ends with spacers $\mathbf{34}_r$, $\mathbf{34}_l$, as shown in FIG. 6(*a*). After the carbon fiber bundles 17 are stretched, a banding carbon fiber bundle 18 is helically wound on and bonded to straight parts of the carbon fiber bundles 17. As a result, U-shaped carbon fiber anchors $\mathbf{35}_r$, $\mathbf{35}_l$ are formed at both ends of the carbon fiber cable 10, as shown in FIG. 6(*b*). Carbon fiber cables $\mathbf{36}_{1r}$, $\mathbf{36}_{1l}$, $\mathbf{36}_{2r}$, $\mathbf{36}_{2l}$ are properly attached to the U-shaped carbon fiber anchors $\mathbf{35}_r$, $\mathbf{35}_l$ by winding carbon fiber reinforcing members $\mathbf{37}_{1r}$, $\mathbf{37}_{1l}$, $\mathbf{37}_{2r}$, $\mathbf{37}_{2l}$ thereon, as shown in FIG. 6(*c*). The fiber cables $\mathbf{36}_{1r}$, $\mathbf{36}_{1l}$, $\mathbf{36}_{2r}$, $\mathbf{36}_{2l}$ are used for stretching the main reinforcing member 10.

The reinforcing members 32, 37 are made of continuous carbon filaments. The stretching carbon fiber cables $\mathbf{36}_{1r}$, $\mathbf{36}_{1l}$, $\mathbf{36}_{2r}$, $\mathbf{36}_{2l}$ are bonded to the integrated t-shaped carbon fiber anchors $\mathbf{35}_r$, $\mathbf{35}_l$, by intertwining filaments of the carbon fiber cables $\mathbf{36}_{1r}$, $\mathbf{36}_{1l}$, $\mathbf{36}_{2r}$, $\mathbf{36}_{2l}$ with filaments of the carbon fiber anchors $\mathbf{35}_r$, $\mathbf{35}_l$, impregnating the intertwined part with a resin bond, and curing the resin bond therein.

A cold-setting low-viscosity resin bond is applied to a surface of the joint, where the U-shaped carbon fiber anchor 33 is bonded to the straight carbon fiber cable 10, or where the stretching carbon fiber cables $\mathbf{36}_{1r}$, $\mathbf{36}_{1l}$, $\mathbf{36}_{2r}$, $\mathbf{36}_{2l}$ are bonded to the U-shaped carbon fiber anchors $\mathbf{35}_r$, $\mathbf{35}_l$ formed at end parts of the straight carbon fiber cable 10. The reinforcing members 32, $\mathbf{37}_{1r}$, $\mathbf{37}_{1l}$, $\mathbf{37}_{2r}$, $\mathbf{37}_{2l}$ are helically wound on the resin bond-applied surface, and then the resin bond is cured so as to firmly integrate the reinforcing members 32, $\mathbf{37}_{1r}$, $\mathbf{37}_{1l}$, $\mathbf{37}_{2r}$, $\mathbf{37}_{2l}$ with the straight carbon fiber cable 10 and the U-shaped carbon fiber anchors 33, $\mathbf{35}_r$, $\mathbf{35}_l$. Each carbon fiber bundle is preferably untied to separate filaments and intertwined together in this case, too.

The bonded joint is strengthened due to presence of the cured resin bond and a tightening force of the reinforcing members 32, $\mathbf{37}_{1r}$, $\mathbf{37}_{1l}$, $\mathbf{37}_{2r}$, $\mathbf{37}_{2l}$. In fact, the U-shaped carbon fiber anchor 33 is firmly bonded to the straight carbon fiber cable 10, or the stretching carbon fiber cables $\mathbf{36}_{1r}$, $\mathbf{36}_{1l}$, $\mathbf{36}_{2r}$, $\mathbf{36}_{2l}$ is firmly bonded to the U-shaped carbon fiber anchors $\mathbf{35}_r$, $\mathbf{35}_l$ formed at end parts of the straight carbon fiber cable 10 by enlarging a contact plane between the carbon fiber filaments, infiltrating a sufficient amount of the resin bond and raising a tightening force of the reinforcing member 32, $\mathbf{37}_{1r}$, $\mathbf{37}_{1l}$, $\mathbf{37}_{2r}$, $\mathbf{37}_{2l}$. In prior to bonding, each carbon fiber bundle is preferably untied to separate filaments at the joint between the straight carbon fiber cable 10 and the U-shaped carbon fiber anchor 33 or between the integrated U-shaped carbon fiber anchors $\mathbf{35}_r$, $\mathbf{35}_l$ and the stretching carbon fiber cable $\mathbf{36}_{1r}$, $\mathbf{36}_{1l}$, $\mathbf{36}_{2r}$, $\mathbf{36}_{2l}$. When the separate carbon fiber filaments are intertwined each other, impregnated with the resin bond and tied with the reinforcing members 32, $\mathbf{37}_{1r}$, $\mathbf{37}_{1l}$, $\mathbf{37}_{2r}$, $\mathbf{37}_{2l}$, the bonded joint is further strengthened due to the cured resin bond in the carbon fiber bundles.

The fabricated straight carbon fiber cable 10 is useful as a stretching cable in a post-tension or pre-tension process for manufacturing a pre-stressed concrete member 20.

[Post-Tension Process]

In a post-tension process, the U-shaped carbon fiber anchor 33 is bonded to the straight carbon fiber cable 10, tentative anchors 40*a*, 40*b* for application of an initial tension are attached to top ends of carbon fiber bundles 13*a*, 13*b* extending from the straight carbon fiber cable 10, and then the carbon fiber bundles 13*a*, 13*b* are inserted in a sheath 21, which preferably has a tapered inner surface 21*t* enlarged toward an opened end, as shown in FIG. 3.

A reinforcing carbon fiber cable 14 may be helically wound on the straight carbon fiber cable 10 and bonded thereto with a resin bond, in prior to insertion of the carbon fiber bundles 13*a*, 13*b* in the sheath 21. Adhesion of grout 22 to the straight carbon fiber cable 10 is improved by the reinforcing carbon fiber cable 14. However, an unbending post-tension process without using the reinforcing carbon fiber cable 14 is also applicable.

Figure 7A:
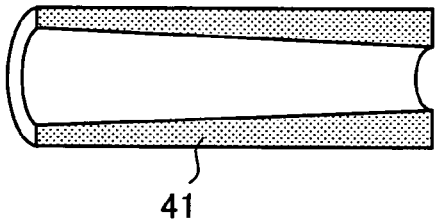
FIG. 7A is a sectional view illustrating a steel pipe of a tentative anchor, which will be fixed to an end of a carbon fiber cable.
Figure 7B:
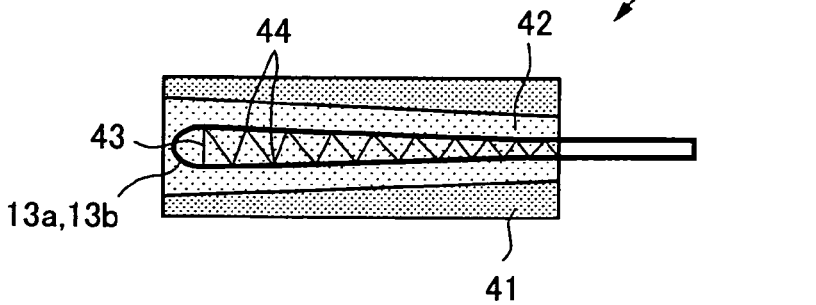
FIG. 7B is a sectional view illustrating the same steel pipe, which has a carbon fiber cable folded and secured therein.

Each tentative anchor 40*a*, 40*b* has a steel pipe 41, whose inner diameter becomes larger from one end to the other end, as shown in FIG. 7A Each carbon fiber bundle 13*a*, 13*b* is folded at its top end, the folded part is inserted in the steel pipe 41 from an opened end of a larger diameter. The folded part is overlaid on the straight carbon fiber cable 10 and integrally bonded thereto with a resin bond. Thereafter, the steel pipe 41 is filled with a expansive resin or concrete 42 so as to prevent the folded part of the carbon fiber bundle 13*a*, 13*b* from dropping off the steel pipe 41, as shown in FIG. 7B. The folded part of the carbon fiber bundle 13*a*, 13*b* may be flattened. Adhesion of the resin or expansive concrete 42 to the folded part of the carbon fiber bundle 13*a*, 13*b* can be improved by a bonding node 44, which is formed by winding a reinforcing carbon fiber bundle 43 on the flat folded part, infiltrating and curing the resin bond in the carbon fiber bundles 13*a*, 13*b* and 43.

A straight carbon fiber multi-cable 10*n* maybe used as a straight carbon fiber cable 10 inserted in a sheath 21, in order to enhance pre-stress strength. The multi-cable 10*n* is also preferably tied with a cold-setting low-viscosity resin bond at proper positions along its longitudinal direction.

Figure 8:
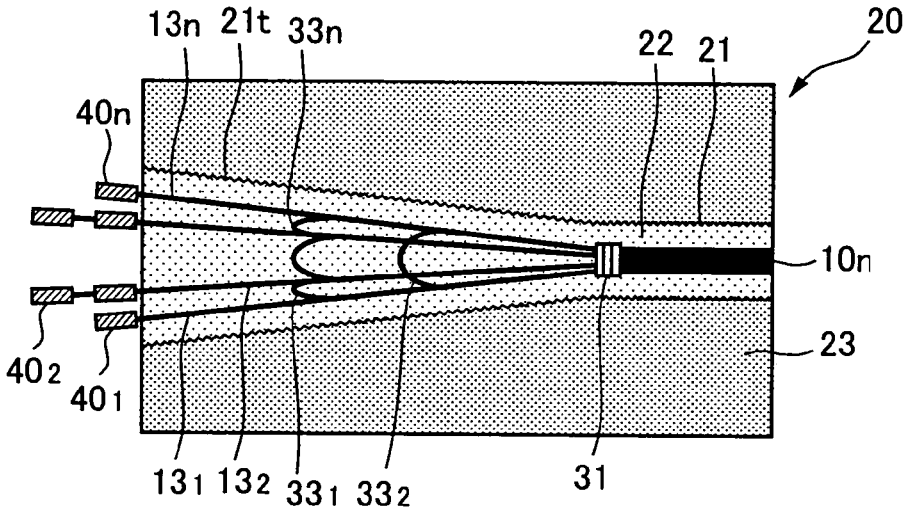
FIG. 8 is a sectional view illustrating attachment of anchors to a carbon fiber multi-cable, which is prepared by uniting two or more straight carbon fiber cables together.

In the case where the straight carbon fiber multi-cable 10*n* is used, each carbon fiber bundle $\mathbf{13}_1$, $\mathbf{13}_2$ . . . $\mathbf{13}_n$ extending from the multi-cable 10*n* is folded and inserted in the sheath 21, as shown in FIG. 8. The carbon fiber bundles $\mathbf{13}_1$, $\mathbf{13}_2$ . . . $\mathbf{13}_n$ are bridged with a plurality of U-shaped carbon fiber anchors $\mathbf{33}_1$, $\mathbf{33}_2$ . . . $\mathbf{33}_n$, and tentative anchors $\mathbf{40}_1$, $\mathbf{40}_2$ . . . $\mathbf{40}_n$ are attached to the carbon fiber bundles $\mathbf{13}_1$, $\mathbf{13}_2$ . . . $\mathbf{13}_n$. The sheath 21, in which the folded parts of the carbon fiber bundles $\mathbf{13}_1$, $\mathbf{13}_2$ . . . $\mathbf{13}_n$ are inserted, is located at one side of a molding box. The multi-cable 10*n* is straightened by stretching each cable of the multi-cable 10*n*.

After the straight carbon fiber cable 10, to which the U-shaped carbon fiber anchor 33 is fixed, or wherein the stretching carbon fiber cables $36_{1r}$, $36_{1l}$, $36_{2r}$, $36_{2l}$ are bonded to the U-shaped carbon fiber anchors $35_r$, $35_l$ formed at end parts of the straight carbon fiber cable 10 (FIGS. 6B and 6C), is inserted in the sheath 21, the straight carbon fiber cable 10 is set in a molding box. Green concrete is poured in the molding box under the condition that the straight carbon fiber cable 10 is stretched by pulling the tentative anchors 40*a*, 40*b*.

After the poured concrete 23 is hardened to a predetermined profile in the molding box, a hydraulic jack is detached from the molding box without relaxation of the straight carbon fiber cable 10. Grout 22 is then poured and hardened in the sheath 21. Thereafter, a tacking tool is unloosed, each carbon fiber bundle 13*a*, 13*b* is cut off at a position between the tentative anchor 40*a*, 40*b* and a concrete body 23. The pre-stressed concrete member 20 is taken out of the molding box and offered for a practical use.

A compression force (i.e. pre-stress), which originates in shrinkage of the straight carbon fiber cable 10 released from a tension, is applied to the pre-stressed concrete member 20 fabricated in this way, since an anchoring effect is realized by the buried carbon fiber anchor 33 and the grout 22 in the sheath 21.

[Pre-tension Process]

Figure 9:
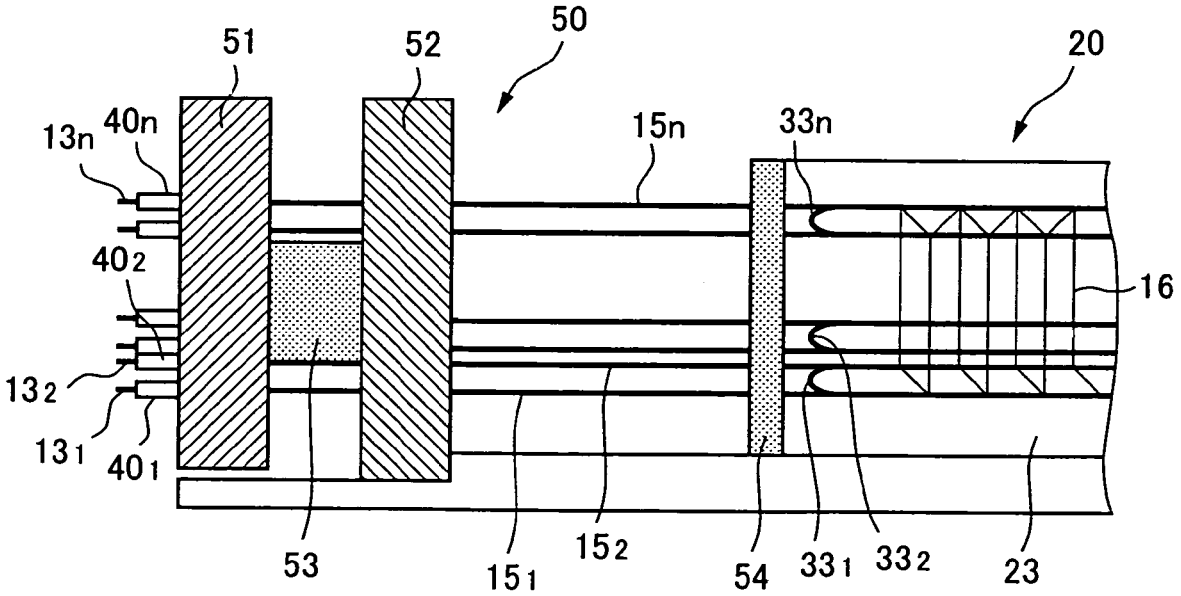
FIG. 9 is a view illustrating a pre-tension process, whereby a pre-stressed concrete member is manufactured, using hooped straight carbon fiber cables.

A pre-tension process uses a pre-tension apparatus 50 having anchor-fixing discs 51, to which tentative anchors $40_1$, $40_2$ . . . $40_n$ can be attached with predetermined positional relationship, at both sides, as shown in FIG. 9. A hydraulic jack 53 is located between each anchor-fixing disc 51 and a bearing wall 52.

Reinforcing members 32, U-shaped carbon fiber anchors 33 and so on are bonded to a straight carbon fiber cable 10 by the same way as the post-tension process, except use of main reinforcing members $15_1$, $15_2$ . . . $15_n$ made of the straight carbon fiber cable 10 and a hoop 16 made of the straight carbon fiber bundle.

A carbon fiber cable, in which a cold-setting low-viscosity resin bond is preparatively infiltrated and cured, may be used as the straight carbon fiber cable 10 for the main reinforcing members $15_1$, $15_2$ . . . $15_n$ and the hoop 16. Each tentative anchor $40_1$, $40_2$ . . . $40_n$ is bonded to a corresponding carbon fiber bundle $13_1$, $13_2$ . . . $13_n$, and attached to a predetermined hole of the anchor-fixing disc 51. A sectional profile of the main reinforcing members $15_1$, $15_2$ . . . $15_n$ (in other words, a pre-stressed concrete member 20) is determined by selection of holes of the anchor-fixing disc 51, to which the tentative anchor $40_1$, $40_2$ . . . $40_n$ are inserted. Each main reinforcing member $15_1$, $15_2$ . . . $15_n$ is held parallel to the other, when its both ends are inserted in the holes of the anchor-fixing discs 51.

The hoop 16 is wound around the main reinforcing members $15_1$, $15_2$ . . . $15_n$, which are held with such positional relationship to define a predetermined sectional profile. The hoop 16 is bonded to the main reinforcing members $15_1$, $15_2$ . . . $15_n$ at crossing points with a resin bond.

The main reinforcing members $15_1$, $15_2$ . . . $15_n$ integrated with the hoop 16 are expanded between the anchor-fixing discs 51, 51, and the tentative anchors $40_1$, $40_2$ . . . $40_n$ are clamped to the anchor-fixing discs 51, 51. After the main reinforcing members $15_1$, $15_2$ . . . $15_n$ are set in a molding box 54, the left-handed anchor-fixing disc 51 is shifted leftwards in FIG. 9 by actuation of the hydraulic jack 53 so as to stretch the main reinforcing members $15_1$, $15_2$ . . . $15_n$. Under the condition that the main reinforcing members $15_1$, $15_2$ . . . $15_n$ are stretched with a certain tension, green concrete is poured in the molding box 54 and steam-aged therein. After the concrete is sufficiently hardened, the hydraulic jack 53 is released from a pressure. The main reinforcing members $15_1$, $15_2$ . . . $15_n$ are cut off at positions between the concrete body 23 and the tentative anchors $40_1$, $40_2$ . . . $40_n$, and the concrete member 20 is separated from the molding box 54.

The pre-stressed concrete member 20 fabricated in this way is strengthened due to a compression force (i.e. pre-stress) originated in shrinkage of the main reinforcing members $15_1$, $15_2$ . . . $15_n$ released from the tension. The bonded joints, where the hoop 16 is bonded to the main reinforcing members $15_1$, $15_2$ . . . $15_n$ at a right angle, act as a series of nodes along a longitudinal direction of the main reinforcing members $15_1$, $15_2$ . . . $15_n$, so as to firmly integrate the main reinforcing members $15_1$, $15_2$ . . . $15_n$ with the concrete body 23 and to realize a dispersion effect of cracks. Consequently, the pre-stressed concrete member 20 is durable over a long term due to mechanical strength of the main reinforcing members $15_1$, $15_2$ . . . $15_n$.

INDUSTRIAL APPLICABILITY

According to the present invention, a straight carbon fiber cable is impregnated with a cold-setting low-viscosity resin bond, stretched and molded as such in a concrete body. Arrangement of reinforcing members is fairly simplified in comparison with a conventional process using a composite member pre-cured with a thermosetting resin, and burial anchors are bonded to the straight carbon fiber cable at proper positions with ease. Since the straight carbon fiber cable is straightened by application of a tension and molded in concrete, the pre-stressed concrete member is improved in tensile strength, fatigue properties and crack-resistance. Moreover, carbon fiber cables are bonded as burial anchors to the reinforcing members instead of conventional metal fitting, so that the pre-stressed concrete member exhibits excellent corrosion-resistance even in a salty atmosphere. The pre-stressed concrete member is also handled with safe, since any part is not projected from its surface.

The invention claimed is:

1. A post-tension method for manufacturing a pre-stressed concrete member, which comprises the steps of:

holding continuous carbon fiber filaments parallel to each other;

preparing a carbon fiber cable by bonding said carbon fiber filaments at positions along a longitudinal direction;

bonding or forming burial anchors near both ends of said carbon fiber cable;

attaching temporary anchors to both ends of said carbon fiber cable outward of said burial anchors;

inserting ends of said carbon fiber cable including said burial anchors in a sheath;

setting said carbon fiber cable within said sheath in a molding box;

pouring green concrete in said molding box;

hardening said poured concrete to a concrete member, in which said carbon fiber is molded;

pouring grout in said sheath under the condition that said carbon fiber cable is stretched by pulling said temporary anchors in a longitudinal direction; and releasing said carbon fiber cable from tension after said grout is hardened in said sheath.

2. The method of claim 1, wherein burial anchors are U-shaped carbon fiber bundles bonded to adjacent carbon fiber cables.

3. The method of claim 1, wherein the carbon fiber cable is prepared by stretching a plurality of carbon fiber bundles arranged parallel to each other in a continuous loop shape with toroidal-shaped ends spaced by generally straight leg sections, winding bandings on said straight leg sections to form loops at each end of said straight leg sections, infiltrating a resin bond to the carbon fiber cables at the banded positions and curing the resin bond, whereby carbon fiber anchors are integrally formed at both ends of the straight carbon fiber cables.

4. The method of claim 1, wherein the burial anchors have a U-shaped profile with a bottom flattened along a direction perpendicular to the longitudinal direction of the stretched carbon fiber cables.

5. A pre-tension method for manufacturing a pre-stressed concrete member, which comprises the steps of:

holding continuous carbon fiber filaments parallel to each other;

preparing carbon fiber cables by bonding said carbon fiber filaments together at positions along a longitudinal direction;

bonding or forming burial anchors to both ends of said carbon fiber cables;

attaching temporary anchors to said carbon fiber cables extending from both ends of said carbon fiber cable outward of the burial anchors;

fixing said temporary anchors to anchor-fixing discs;

winding a carbon fiber hoop around said carbon fiber cables;

bonding said carbon fiber hoop to said carbon fiber cables;

setting said carbon fiber cables together with said bonded hoop in a molding box;

pouring green concrete in said molding box under the condition that said carbon fiber cables are stretched in a longitudinal direction;

steam-aging said concrete to a hardened concrete body; and releasing the carbon cables from tension.

6. The method according to claim 5, wherein the burial anchors are U-shaped carbon fiber bundles bonded to said carbon fiber cables.

7. The method of claim 5, wherein the carbon fiber cables are prepared by stretching a plurality of carbon fiber bundles arranged parallel to each other in a continuous loop shape with toroidal-shaped ends spaced by generally straight leg sections, winding banding on said fiber bundle on straight leg sections of the carbon fiber cables, infiltrating a resin bond to the carbon fiber cables at banded positions and curing the resin bond, whereby carbon fiber anchors are integrally formed at the both ends of said carbon fiber cables.

8. The method of claim 5, wherein the burial anchors have a U-shaped profile with a bottom flattened along a direction perpendicular to the longitudinal direction of the carbon fiber cables.

* * * * *